United States Patent [19]

Zakai

[11] Patent Number: 4,796,810

[45] Date of Patent: Jan. 10, 1989

[54] ROTARY IRRIGATION SPRINKLER

[75] Inventor: Avi Zakai, Rishon Le-Zion, Israel

[73] Assignee: Dan Mamtirim, Kibbutz Dan Galil Elyon, Israel

[21] Appl. No.: 77,209

[22] Filed: Jul. 24, 1987

[30] Foreign Application Priority Data

Sep. 18, 1986 [IL] Israel ..... 80074

[51] Int. Cl.[4] ..... B05B 3/04; B05B 1/34; B05B 1/30; A62C 31/02

[52] U.S. Cl. ..... 239/222.17; 239/222.21; 239/383; 239/572; 239/601

[58] Field of Search ..... 239/222.11, 222.17, 239/222.21, 380–383, 462, 542, 572, 601

[56] References Cited

U.S. PATENT DOCUMENTS

| | | | |
|---|---|---|---|
| 768,618 | 8/1904 | Neumeyer | 239/222.17 |
| 1,161,205 | 11/1915 | Finley | 239/222.17 |
| 2,949,249 | 8/1960 | Slonim | 239/222.17 X |
| 3,437,274 | 4/1969 | Apri | 239/601 X |
| 4,498,628 | 2/1985 | Tucker | 239/381 |
| 4,524,913 | 6/1985 | Bron | 239/222.17 |
| 4,583,689 | 4/1986 | Rosenberg | 239/381 |

*Primary Examiner*—Andres Kashnikow
*Assistant Examiner*—Patrick N. Burkhart
*Attorney, Agent, or Firm*—Browdy & Neimark

[57] ABSTRACT

In a rotary irrigation mini-sprinkler of the kind comprising a housing having a housing inlet and a housing outlet and, intermediate thereof, a differential pressure control means responsive to variations in the pressure differential between the inlet and outlet and including a throughflow path serving to communicate with said housing inlet and outlet, the throughflow dimensions of the path varying in accordance with the differential, the improvement wherein the housing outlet includes an outflow port in direct communication with the path and having a non-circular cross-sectional shape such as to reduce substantially the velocity of water entering the port from the path and thereby ensuring that the water fully occupies the port.

2 Claims, 1 Drawing Sheet

ROTARY IRRIGATION SPRINKLER

This invention relates to a rotary irrigation sprinkler.

The invention particularly relates to a rotary irrigation mini-sprinkler of the kind, hereafter referred to as being of the kind specified, and comprising a housing having a housing inlet and a housing outlet and, intermediate thereof, a differential pressure control means responsive to variations in the pressure differential between the inlet and outlet and including a throughflow path serving to communicate with the housing inlet and outlet, the dimensions of the throughflow path varying in accordance with said pressure differential.

With such rotary irrigation mini-sprinklers of the kind specified, the irrigation water emerging from the housing outlet passes to an outlet nozzle, imparting to the latter, a turning couple so that a rotary spray emerges from the nozzle outlet.

It has been found in practice that with rotary irrigation mini-sprinklers of the kind specified, the restriction of the dimensions of the throughflow path referred to above results in the water emerging from the throughflow path into the outlet of the housing and therefrom into the outlet nozzle at a relatively substantially high velocity and with the consequence that the liquid flowing out of the throughflow path is non-uniformly distributed throughout the outlet of the housing. Such non-uniform distribution of the irrigation water in the outlet of the housing and in the outlet nozzle has deleterious consequences on the effective production of a uniform rotary spray.

It is an object of the present invention to provide a new and improved rotary irrigation minisprinkler of the kind specified wherein the above referred to disadvantage is substantially reduced or overcome.

According to the present invention there is provided, in a rotary irrigation mini-sprinkler of the kind comprising a housing having a housing inlet and a housing outlet and, intermediate thereof, a differential pressure control means responsive to variations in the pressure differential between the inlet and outlet and including a throughflow path serving to communicate with said housing inlet and outlet, the throughflow dimensions of said path varying in accordance with said differential; the improvement wherein said housing outlet includes an outflow port in direct communication with said path and having a non-circular cross-sectional shape such as to reduce substantially the velocity of water entering said port from said path and thereby ensuring that the water fully occupies said port.

Figure 1:
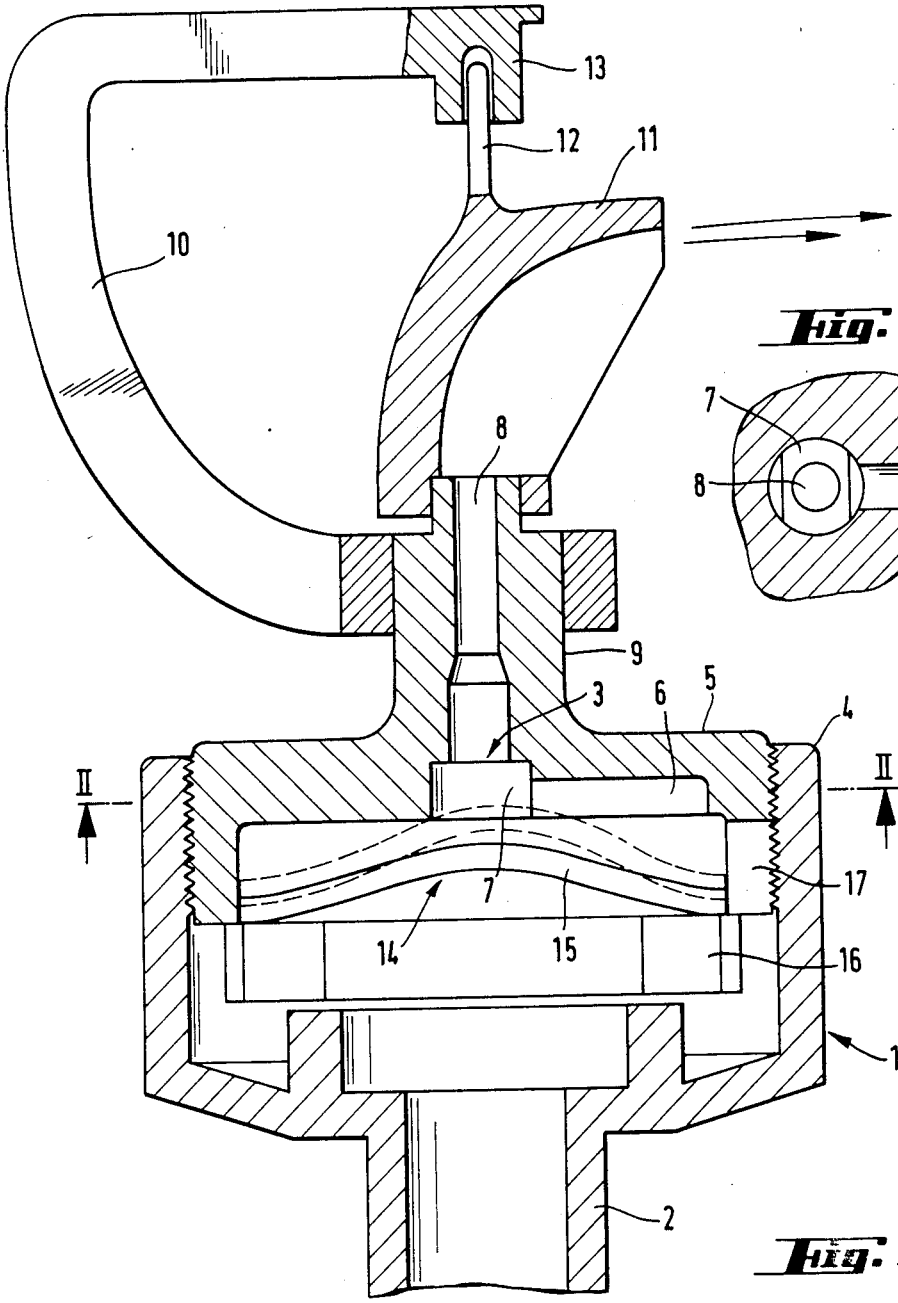
Figure 2:
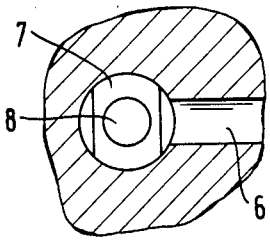

For a better understanding of the present invention and to show how the same may be carried out in practice, reference will now be made to the accompanying drawings in which FIG. 1 is a longitudinally sectioned elevation of a rotary irrigation mini-sprinkler in accordance with the present invention; and FIG. 2 is a cross-sectional view of a portion of the mini-sprinkler shown in FIG. 1 taken along the line II—II.

As seen in the drawings, the irrigation minisprinkler comprises a housing 1 having a housing inlet 2 and a housing outlet 3. The housing 1 consists of an outer casing 4 and, screw coupled therein, an inner casing 5. The inner casing 5 has formed therein a housing outlet

3 which comprises a radial throughflow path 6 terminating in an outlet port 7 which in turn communicates with an outlet duct 8. The inner casing 5 has an upwardly directed portion 9 through which extends the outlet duct 8. Mounted on the upwardly directed portion 9 is a support arm 10 which carries a rotary outlet nozzle 11. The latter is formed integrally with a guide rod 12 rotatably mounted in a bushing 13 formed integrally with the support arm 10.

Between the outlet 3 and the inlet 2 is located a differential pressure control means 14 which comprises a flexible membrane 15, communication between the inlet 2 and outlet 3 being via side apertures 16 and 17 and the throughflow path 6.

As can be seen clearly in FIG. 2 of the drawings, the outlet port 7 is of non-circular (specifically substantially rectangular) cross-sectional shape.

In use, when the mini-sprinkler is coupled to an irrigation supply a pressure differential is established on either side of the flexible membrane 15 determining an equilibrium position of the membrane 15 as shown in full lines in the drawing. If, however, as a result for example of a substantial increase in the supply of pressure, this pressure differential varies, then the membrane will flex into the dotted line position wherein it effectively restricts the throughflow dimensions in the throughflow path 6, tending to restore the predetermined pressure differential.

By, however, restricting the throughflow dimensions of the throughflow path 6 the entry of the water into the outlet port takes place at a relatively increased velocity and this would normally militate against the supply water fully filling the outlet port with consequential deleterious effects on the flow of the irrigation water to the outlet nozzle 11. By virtue of the fact, however, that the outlet port 7 is of noncircular cross-sectional shape, the water flowing into the outlet port is subjected to continuing resistance to flow, thereby ensuring that the waterflow stream is effectively broken up and fully occupies the outlet port.

It will be appreciated that whilst in the specific embodiment shown above the outlet port 7 is of substantially rectangular cross-sectional shape, other non-circular shapes may equally well be employed, which serve to introduce a resistance to flow and thereby reduce the velocity of the water flowing into the outlet port 7.

I claim:

1. In a rotary irrigation mini-sprinkler of the kind comprising a housing having a housing inlet and a housing outlet and, intermediate thereof, a differential pressure control means responsive to variations in the pressure differential between the inlet and outlet and including a throughflow path serving to communicate with said housing inlet and outlet, the throughflow dimensions of said path varying in accordance with said differential, the improvement wherein said housing outlet includes an outflow port in direct communication with said path and having a non-circular transverse cross-sectional shape such as to reduce substantially the velocity of water entering said port from said path and thereby ensuring that the water fully occupies said port.

2. The improvement according to claim 1 wherein said outflow port is formed with substantially rectilinear portions.

* * * * *